US011076654B2

(12) United States Patent
McAllister et al.

(10) Patent No.: US 11,076,654 B2
(45) Date of Patent: Aug. 3, 2021

(54) LIGHT SOURCES IN ENERGY MANAGEMENT LINER OF A HELMET TO ILLUMINATE HELMET FIT SYSTEM

(71) Applicant: Bell Sports, Inc., Scotts Valley, CA (US)

(72) Inventors: Ian P. McAllister, Hermosa Beach, CA (US); Mark D. Doublin, Fullerton, CA (US); Ronald A. Ramirez, Long Beach, CA (US)

(73) Assignee: BELL SPORTS, INC., Scotts Valley, CA (US)

( * ) Notice: Subject to any disclaimer, the term of this patent is extended or adjusted under 35 U.S.C. 154(b) by 0 days.

(21) Appl. No.: 15/974,657

(22) Filed: May 8, 2018

(65) Prior Publication Data

US 2018/0325202 A1 Nov. 15, 2018

Related U.S. Application Data

(60) Provisional application No. 62/503,842, filed on May 9, 2017.

(51) Int. Cl.

| | |
|---|---|
| ***A42B 3/04*** | (2006.01) |
| ***A42B 3/06*** | (2006.01) |
| ***A42B 3/12*** | (2006.01) |
| *A42B 3/08* | (2006.01) |
| *F21V 23/00* | (2015.01) |
| *F21Y 115/10* | (2016.01) |

(52) U.S. Cl.

CPC ..... *A42B 3/044* (2013.01); *A42B 3/06* (2013.01); *A42B 3/125* (2013.01); *A42B 3/08* (2013.01); *F21V 23/001* (2013.01); *F21V 23/003* (2013.01); *F21Y 2115/10* (2016.08)

(58) Field of Classification Search

CPC ..... A42B 3/044; A42B 3/06; A42B 3/125; A42B 3/08; G08B 5/004; A44C 15/0015; G02B 6/001

USPC ..... 362/105, 106

See application file for complete search history.

(56) References Cited

U.S. PATENT DOCUMENTS 3,994,560 A * 11/1976 Rice ..... G08B 5/004 359/516
4,101,698 A 7/1978 Dunning et al.
4,523,258 A * 6/1985 Morse ..... F21V 33/0008 362/108

(Continued)

FOREIGN PATENT DOCUMENTS

WO 2016134675 A1 9/2016

OTHER PUBLICATIONS

Guisan, Thierry, European Search Report and Search Opinion for EP 18799396.9, dated Apr. 12, 2021, pp. 1-10, European Patent Office, Munich Germany.

*Primary Examiner* — Rajarshi Chakraborty
*Assistant Examiner* — Michael Chiang
(74) *Attorney, Agent, or Firm* — Walter M. Egbert, III; Gerard M. Donovan; Reed Smith LLP

(57) ABSTRACT

A helmet including fit system straps with illuminable strips on them or woven into them and one or more light sources positioned adjacent the tops of the fit system straps on the helmet body to emit light toward the illuminable strips. The light sources may be connected directly to the illuminable strips to emit light into an end of the illuminable strips. The light sources may emit light from or near a lower surface of the helmet body toward the illuminable strips.

20 Claims, 6 Drawing Sheets

(56) References Cited

U.S. PATENT DOCUMENTS

| | | | | | |
|---|---|---|---|---|---|
| 5,722,757 | A * | 3/1998 | Chien | A43B 3/001 | 362/555 |
| 5,931,559 | A * | 8/1999 | Pfaeffle | A42B 3/044 | 362/106 |
| 6,106,130 | A * | 8/2000 | Harding | A41D 13/01 | 362/103 |
| 6,150,950 | A * | 11/2000 | Shen Liu | A44C 15/0015 | 340/321 |
| 9,247,717 | B2 * | 2/2016 | Hurwitz | A01K 27/006 | |
| 2003/0231485 | A1 * | 12/2003 | Chien | A41D 27/085 | 362/84 |
| 2009/0034238 | A1 * | 2/2009 | Hurwitz | A42B 3/044 | 362/106 |
| 2010/0177505 | A1 * | 7/2010 | Ho | A42B 3/044 | 362/106 |
| 2011/0289658 | A1 | 12/2011 | Knoepfli | | |
| 2012/0120638 | A1 * | 5/2012 | Gonzalez | A45C 13/30 | 362/154 |
| 2013/0182414 | A1 * | 7/2013 | Fedewa | A42B 3/0446 | 362/106 |
| 2018/0064969 | A1 * | 3/2018 | Lopez | A62B 35/0025 | |

* cited by examiner

LIGHT SOURCES IN ENERGY MANAGEMENT LINER OF A HELMET TO ILLUMINATE HELMET FIT SYSTEM

RELATED APPLICATIONS

This application claims the benefit of U.S. provisional patent application 62/503,842, filed May 9, 2017 titled "LED Light in EPS Foam to Illuminate Helmet Retention System," the entirety of the disclosure of which is incorporated by this reference.

TECHNICAL FIELD

Aspects of this document relate generally to helmets having illuminable fit system, and more specifically to a helmet comprising illuminable straps and methods for increase the visibility of the helmet.

BACKGROUND

Protective headgear and helmets have wide uses. Helmets not only can be used to protect a wearer's head in an accident, but can also be used to increase visibility of the wearer to reduce the likelihood of an accident. Although increasing the visibility of the helmet and its wearer is not a guarantee of protection against an accident, it may reduce the likelihood of a wearer being involved in an accident by making the wearer more visible to others on and off the road.

SUMMARY

According to an aspect, a helmet may comprise a helmet body including an inner surface, an outer surface and a lower surface extending between the inner surface and the outer surface, the helmet body comprising an energy-management liner disposed between the inner surface and the outer surface and an outer shell covering at least a majority of the energy-management liner, the helmet body further including a first side and a second side opposite the first side, a fit system comprising a first strap and a second strap, the first strap attached to the helmet body adjacent the lower surface at one or more first attachment points on the first side of the helmet body, the second strap attached to the helmet body adjacent the lower surface at one or more second attachment points on the second side of the helmet body, the first strap comprising one or more first illuminable strips disposed on one or more first outward-facing surfaces of the first strap, the second strap comprising one or more second illuminable strips disposed on one or more second outward-facing surfaces of the second strap, one or more first light sources positioned adjacent the one or more first attachment points on the first side of the helmet and within the energy-management liner, at least one of the one or more first light sources configured to emit a first light toward the one or more first illuminable strips of the first strap, and one or more second light sources positioned adjacent the one or more second attachment points on the second side of the helmet and within the energy-management liner, at least one of the one or more second light sources configured to emit a second light toward the one or more second illuminable strips of the second strap.

Particular embodiments may comprise one or more of the following features. The one or more first light sources may be positioned at the one or more first attachment points to emit the first light from the one or more first attachment points through at least a portion of the one or more first illuminable strips. The one or more first light sources may be positioned adjacent the lower surface of the helmet body and are positioned to emit the first light toward the one or more first illuminable strips of the first strap from the lower surface of the helmet body. The one or more first illuminable strips of the first strap may comprise thermoplastic polyurethane. A controller operably coupled with the one or more first light sources. The one or more first illuminable strips may be coupled with the first strap via one or more translucent covers on the first strap. The first strap may further comprise a pocket formed by the one or more translucent covers, and at least a majority of at least one of the one or more first illuminable strips is disposed within the pocket. The one or more first light sources may be attached to an end of the one or more first illuminable strips.

According to an aspect, a helmet may comprise a helmet body including an inner surface, an outer surface and a lower surface extending between the inner surface and the outer surface, the helmet body comprising an energy-management liner disposed between the inner surface and the outer surface, the helmet body further including a first side and a second side, a fit system comprising a first strap and a second strap, the first strap attached to the helmet body at one or more first attachment points on the first side of the helmet body, the second strap attached to the helmet body at one or more second attachment points on the second side of the helmet body, wherein at least a portion of the first strap and a portion of the second strap are illuminable, one or more first light sources positioned adjacent the lower surface on the first side of the helmet body and configured to emit a first light from adjacent the lower surface toward the first strap, and one or more second light sources positioned adjacent the lower surface on the second side of the helmet body and configured to emit a second light from adjacent the lower surface toward the second strap.

Particular embodiments may comprise one or more of the following features. At least one of the one or more first light sources may be positioned directly superior to at least one of the one or more first attachment points. The one or more first light sources may be positioned to emit the first light toward illuminable surfaces of the first strap. The first strap may comprise one or more first illuminable strips. The one or more first illuminable strips may be coupled to the first strap via one or more translucent covers. The first strap may further comprise a pocket formed by the one or more translucent covers, and at least a majority of at least one of the one or more first illuminable strips is disposed within the pocket. A controller operably coupled to the one or more first light sources. The one or more first light sources may be coupled to an end of the first strap.

According to an aspect, a method for increasing visibility of a helmet may comprise forming a helmet body that includes an energy-management liner, wherein the helmet body comprises an inner surface, an outer surface, and a lower surface extending between the inner surface and the outer surface, attaching a first strap onto a first side of the helmet body such that one or more first illuminable surfaces of the first strap face outward, attaching a second strap onto a second side of the helmet body such that one or more second illuminable surfaces of the second strap face outward, positioning one or more first light sources adjacent the lower surface on the first side of the helmet body such that the one or more first light sources emit a first light toward the one or more first illuminable surfaces, and positioning one or more second light sources adjacent the lower surface on the second side of the helmet body such that the one or more second light sources emit a second light toward the one or more second illuminable surfaces.

Particular embodiments may comprise one or more of the following features. Attaching a first strap may further comprise attaching one or more first illuminable strips having the one or more first illuminable surfaces onto the first strap. Coupling the one or more first illuminable strips onto the first strap via one or more translucent covers. Coupling the one or more first light sources to an end of the first strap.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain, and ordinary meaning to the terms be applied to the interpretation of the specification and claims.

The inventors are also aware of the normal precepts of English grammar. Thus, if a noun, term, or phrase is intended to be further characterized, specified, or narrowed in some way, such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112, ¶6. Thus, the use of the words "function," "means" or "step" in the Detailed Description or Description of the Drawings or claims is not intended to somehow indicate a desire to invoke the special provisions of 35 U.S.C. § 112, ¶6, to define the invention. To the contrary, if the provisions of 35 U.S.C. § 112, ¶6 are sought to be invoked to define the inventions, the claims will specifically and expressly state the exact phrases "means for" or "step for", and will also recite the word "function" (i.e., will state "means for performing the function of [insert function]"), without also reciting in such phrases any structure, material, or acts in support of the function. Thus, even when the claims recite a "means for performing the function of . . . " or "step for performing the function of . . . ," if the claims also recite any structure, material, or acts in support of that means or step, or to perform the recited function, it is the clear intention of the inventors not to invoke the provisions of 35 U.S.C. § 112, ¶6. Moreover, even if the provisions of 35 U.S.C. § 112, ¶6, are invoked to define the claimed aspects, it is intended that these aspects not be limited only to the specific structure, material, or acts that are described in the preferred embodiments, but in addition, include any and all structures, material, or acts that perform the claimed function as described in alternative embodiments or forms in the disclosure, or that are well-known present or later-developed, equivalent structures, material, or acts for performing the claimed function.

The foregoing and other aspects, features, and advantages will be apparent to those artisans of ordinary skill in the art from the DETAILED DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DETAILED DESCRIPTION

Figure 1A:
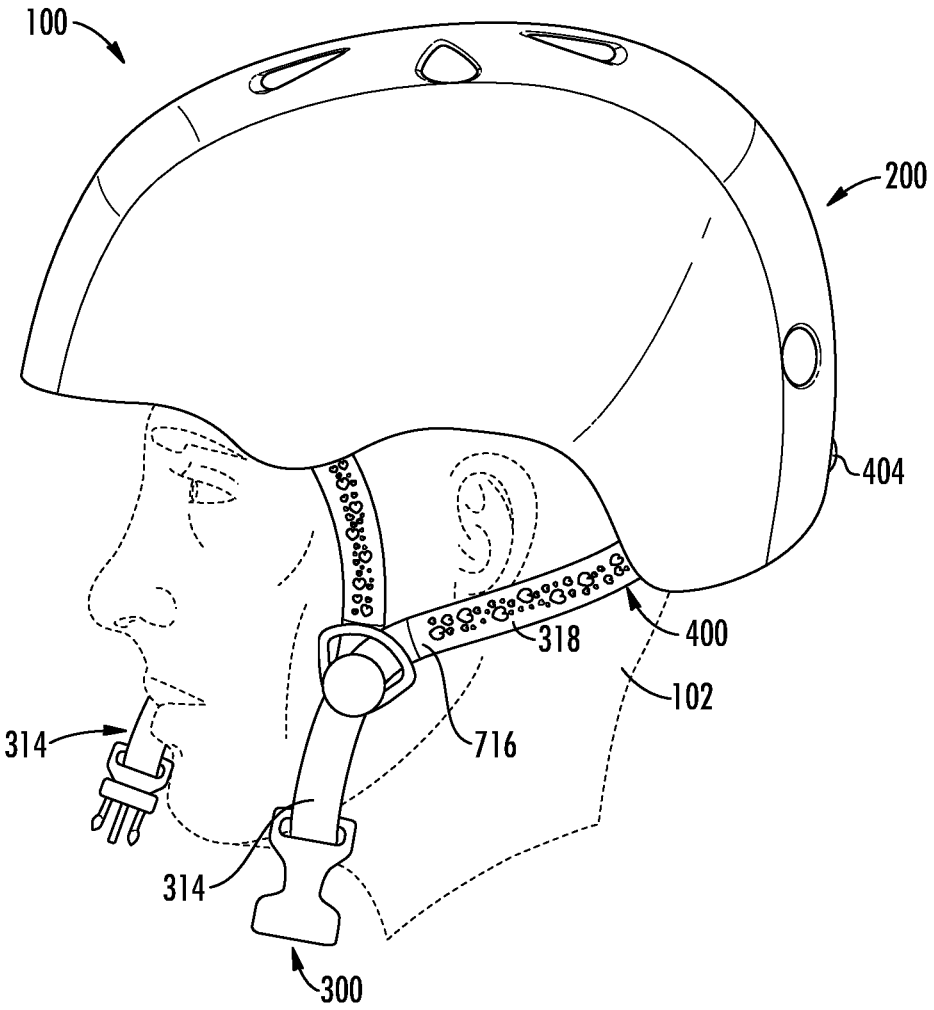
FIG. 1A is a side view of a helmet worn on a wearer's head.

While this disclosure includes embodiments in many different forms, they are shown in the drawings and will herein be described in detailed particular embodiments with the understanding that the present disclosure is to be considered as an exemplification of the principles of the disclosed methods and systems, and is not intended to limit the broad aspect of the disclosed concepts to the embodiments illustrated.

Protective head gear and helmets have been used in a wide variety of applications and across a number of industries including recreation, sports, athletics, construction, mining, military defense, and others, to prevent damage to users' heads and brains. Damage and injury to a user can be prevented or reduced by preventing hard objects, sharp objects, or both, from directly contacting the user's head, and also by absorbing, distributing, or otherwise managing energy of an impact between the object and the user's head. Straps or webbing are typically used to allow a wearer to releasably wear the helmet, and to ensure the helmet remains on the wearer's head during an impact.

Protective headgear or helmets can be used for a snow skier, cyclist, football player, hockey player, baseball player, lacrosse player, polo player, climber, auto racer, motorcycle rider, motocross racer, snowboarder or other snow or water athlete, sky diver, or any other athlete, recreational or professional, in a sport. Other non-athlete users such as workers involved in industry, including without limitation construction workers or other workers or persons in dangerous work environments can also benefit from the protective headgear described herein, as well as the system and method for providing the protective head gear.

Helmets function to provide protection while minimizing interference with an activity. The shape of a helmet may be adapted to provide both protection and comfort (e.g. allowing ventilation and variation of sizes). Some helmets are made of two or more bodies of energy-absorbing material formed in shapes that would be difficult, if not impossible, to achieve in a single molded piece.

Various implementations and embodiments of protective helmets according to this disclosure comprise a protective shell. The protective shell may be formed of an energy absorbing material such as expanded polystyrene (EPS), expanded polyurethane (EPU), expanded polyolefin (EPO), expanded polypropylene (EPP), or other suitable material. The energy absorbing material can be used as part of a hard-shell helmet such as skate bucket helmets, motorcycle helmets, snow sport helmets, football helmets, batting helmets, catcher's helmets, or hockey helmets, and include an additional outer protective shell disposed outside, or over, the protective shell. In hard shell applications, the energy absorbing material may comprise one or more layers of EPP and provide more flexibility. Alternatively, the energy absorbing material may be part of an in-molded helmet such as a bicycle helmet. An outer shell, such as a layer of stamped polyethylene terephthalate or a polycarbonate shell, or some other material like polyvinyl chloride (PVC) or acrylonitrile butadiene styrene (ABS), may be included on an outer surface of the protective shell of the helmet and be bonded directly to the energy management liner.

Visibility of conventional helmets has been dealt with in a number of different ways. One way is through the placement of lights on an outer surface of the helmet pointing toward potential surrounding viewers, or beneath a surface of a helmet to illuminate a cover on the outer surface of the helmet with the light. Light-emitting diodes (LEDs) and incandescent bulbs have both been used in helmets. Additionally, reflective strips have been placed on various parts of a helmet outer shell to increase visibility of the helmet when external lights are shined on the helmet. Reflective strips, however, require a light source external to the helmet to be useful, and do not self-illuminate.

Figure 1B:
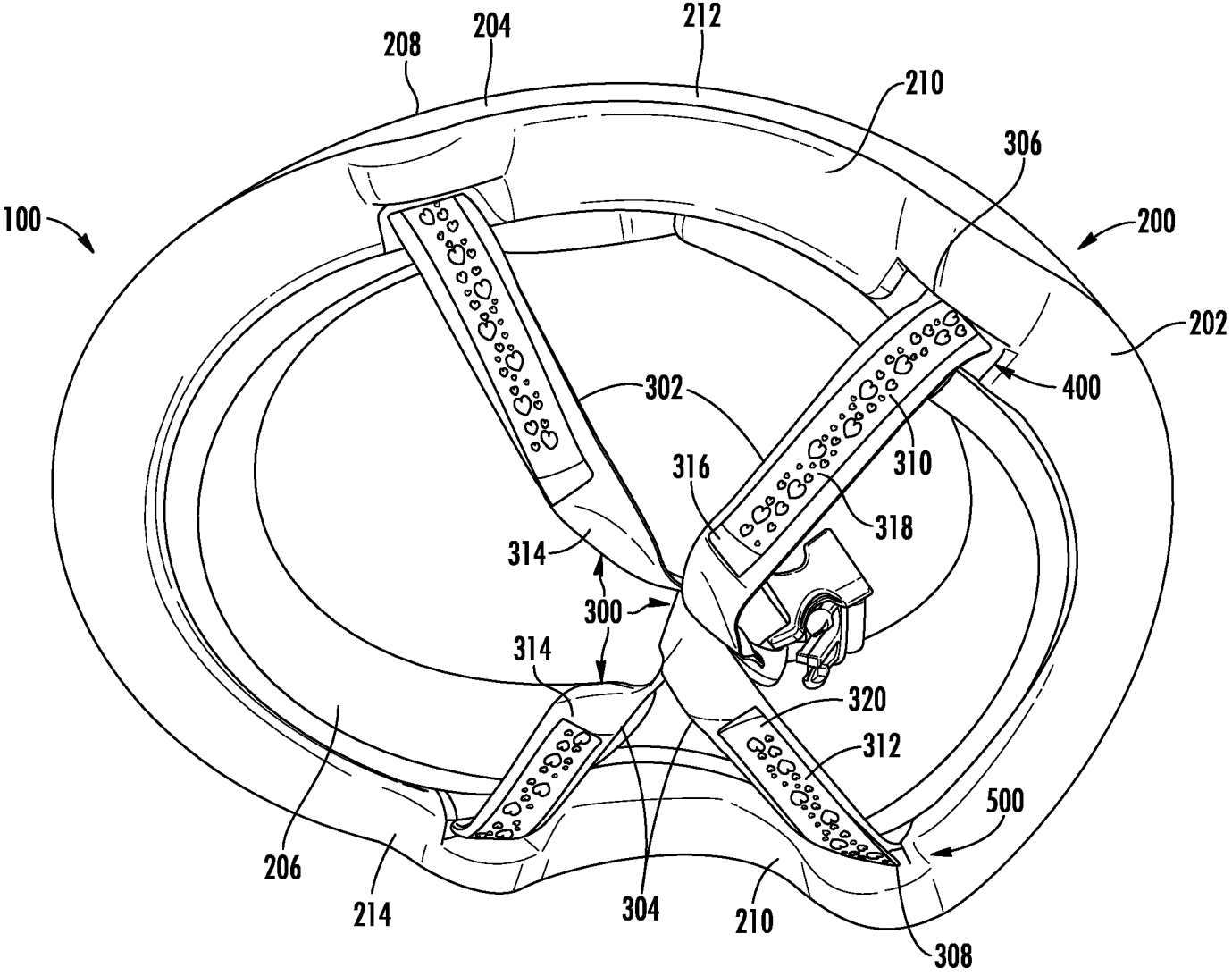
FIG. 1B is a bottom view of the helmet shown in FIG. 1A.
Figure 2:
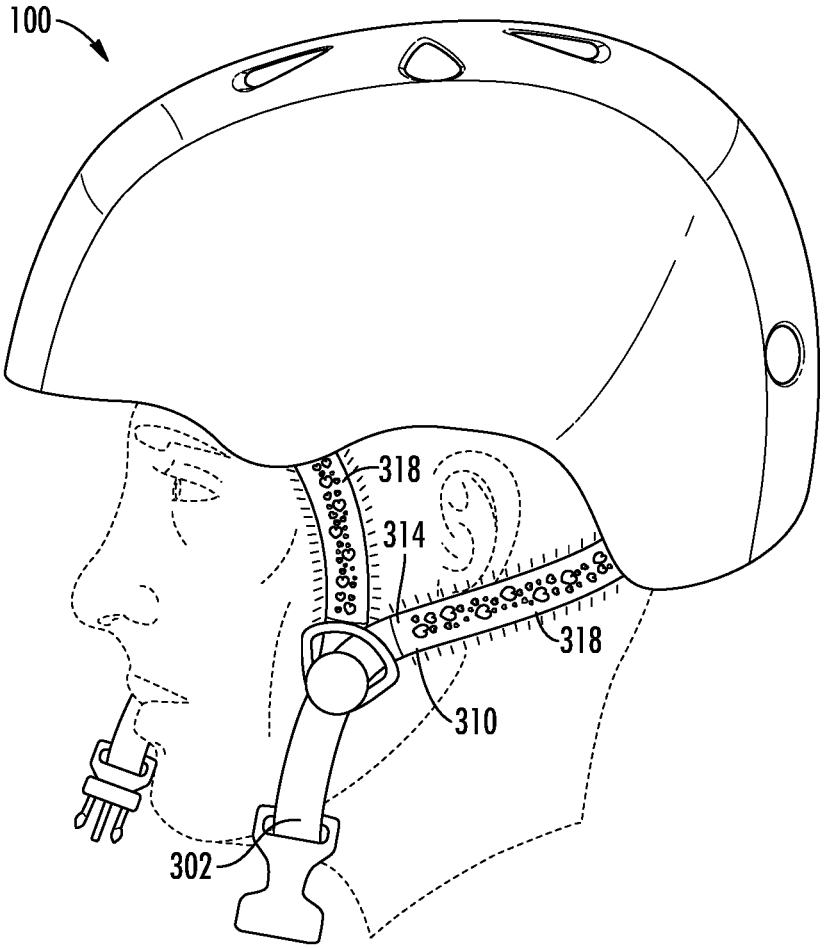
FIG. 2 is a side view of the helmet shown in FIG. 1A worn on a wearer's head with a strap illuminated.

Contemplated as part of this disclosure is a helmet having an illuminable fit system as well as a method for increasing the visibility of a helmet. FIGS. 1A-2 illustrate an example helmet 100. FIG. 1A shows the helmet 100 worn on a wearer's head 102. FIG. 1B shows the underside of the helmet 100 with the outward-facing surfaces 314 facing a viewer. FIG. 2 shows that the outward-facing surface 314 of a strap 302 of the helmet 100 is illuminated.

A helmet 100 comprises a helmet body 200 and a fit system 300. The helmet 100 further comprises one or more first light sources 400 and one or more second light sources 500 (FIG. 1B).

The helmet body 200 comprises an energy-management liner 202. According to various embodiments, a helmet body may comprise one or more types of energy-absorbing material, such as EPS, EPU, EPO, EPP, or other suitable material known in the art to form the energy-management liner. The helmet body 200 may further comprise an outer shell 204 that covers at least a majority of the energy-management liner 202. In some embodiments, the helmet body may be without an outer shell. The helmet body 200 comprises an inner surface 206, an outer surface 208, and a lower surface 210 that extends between the inner surface 206 and the outer surface 208. The helmet body 200 comprises a first side 212 and a second side 214. The second side 214 may be opposite the first side 212.

The fit system 300 of the helmet 100 comprises a first strap 302 and a second strap 304. The first strap 302 is disposed on the first side 212 of the helmet body 200 at one or more first attachment points 306 on the first side. The second strap 304 is disposed on the second side 214 of the helmet body 200 at one or more second attachment points 308 on the second side 214. The first strap 302 and the second strap 304 may be formed from one continuous strap having two end straps with one end strap as the first strap 302 and the other end strap as the second strap 304, or may be formed from separate strap parts.

The straps disclosed herein are illuminable to increase the visibility of a helmet and/or attractiveness of the helmet, especially at dark, regardless of whether any external light source is available or is shining on the straps. Lights from light sources installed on the helmet illuminate the straps so to increase the visibility of the helmet.

The first strap 302 and the second strap 304 are illuminable (FIGS. 1A-4), and comprise illuminable components. In some embodiments, the illuminable component comprises an illuminable strip 310, 312 coupled to the first strap 302 or the second strap 304. The illuminable strips may be pliable. In other embodiments, the illuminable component is woven into the straps. Woven components may be accomplished with reflective thread materials or with fiber optic materials for internal illumination.

In some embodiments, the first strap 302 comprises first illuminable surfaces 318, and the second strap 304 comprises second illuminable surfaces 320 (FIG. 1B). The illuminable surfaces 318, 320 face outward such that, when the helmet is strapped on the wearer, the illuminable surfaces 318, 320 are facing away from the face of the wearer (FIGS. 1A and 2).

In some embodiments, one or more first illuminable strips 310 and one or more second illuminable strips 312 are disposed on the outward-facing surfaces 314 of the straps 302, 304 and comprise the illuminating surfaces 318, 320 (FIG. 1B). When the helmet 100 is strapped on a wearer and the light sources 400, 500 (FIGS. 3-5) are turned on, the outward-facing surfaces 314 or part of them are visible to others. The first illuminable strip 310 and the second illuminable strip 312 may be formed of thermoplastic polyurethane. The illuminable strips 310, 312 may be coupled to the straps 302, 304 via a translucent cover 316. The translucent cover 316 may be formed of polyvinylchloride. The translucent cover 316 may be attached to the strap 302, 304 by sewing, gluing, stapling, or other methods known to a person skilled in the art. The translucent cover 316 may form a pocket 322, with the edges of the translucent cover 316 attached to the strap 302, 304. An illuminable strip 310, 312 may be inserted into the pocket 322 so that at least a majority of the illuminable strip 310, 312 is placed inside the pocket 322.

Figure 3:
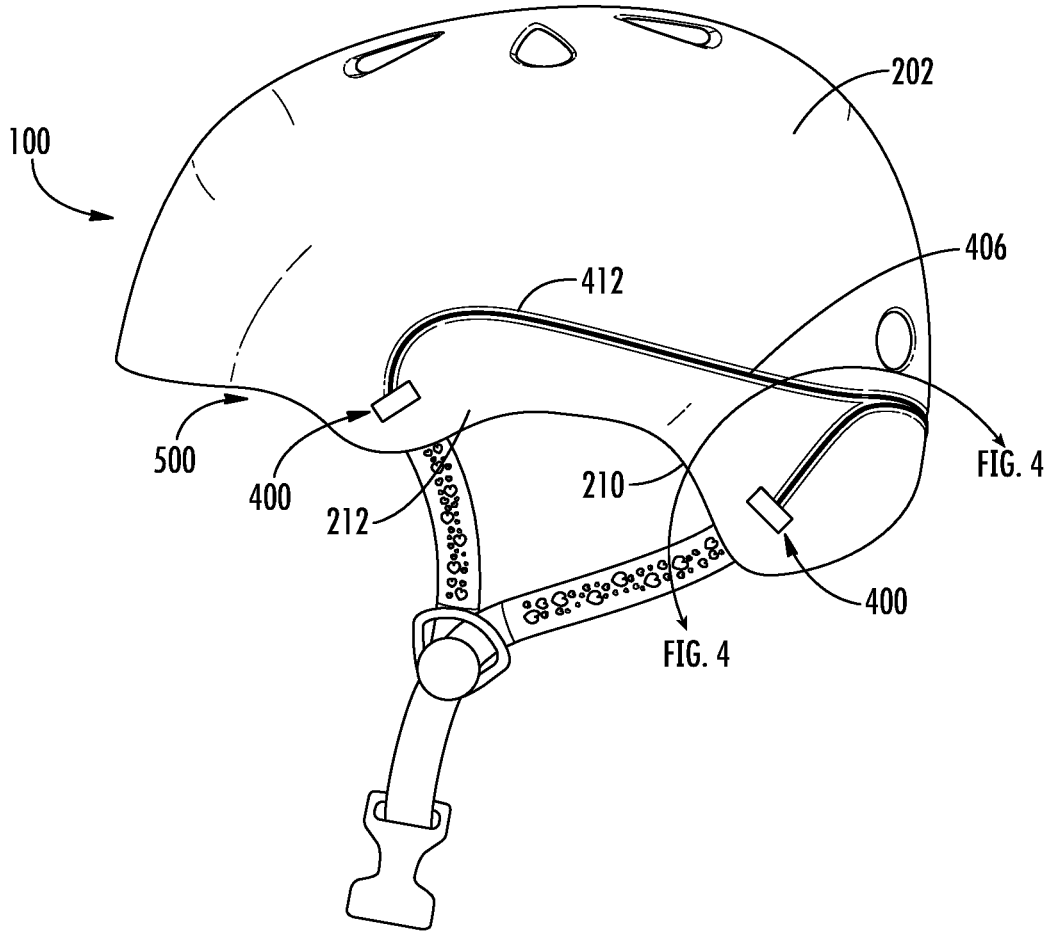
FIG. 3 is a side view of the helmet shown in FIG. 1A with the outer shell removed.
Figure 5:
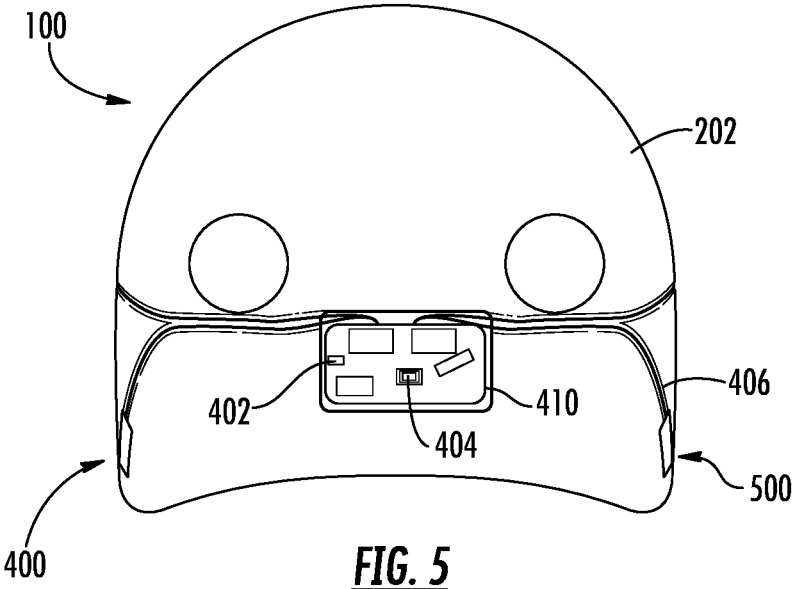
FIG. 5 shows a rear view of the helmet shown in FIG. 3.

The first light sources 400 and the second light sources 500 are configured to illuminate the first strap 302 and the second strap 304. FIGS. 1B, 3 and 5 show the positions of the light sources 400, 500. FIGS. 3 and 5 show an example wiring in the helmet 100 to light up the light sources 400, 500. The first light sources 400 may be positioned adjacent the lower surface 210 on the first side 212. The second light sources 500 may be positioned adjacent the lower surface 210 on the second side 214. The first and second light sources 400, 500 may be disposed within the energy-management liner 202 or at an edge of the energy-management liner 202. One or more light sources 400, 500 may be positioned at the top of the first strap 302 and the second strap 304, or elsewhere along the edge of the energy-management liner. When placed at the top of the first and second straps 302, 304, the light sources 400, 500 are positioned at first or second attachment points 306, 308. In some embodiments, the light sources 400, 500 are positioned directly superior to the first or second attachment points 306, 308. "A superior to B" means "A" positioned further toward the top of the head of a human than "B."

Figure 4:
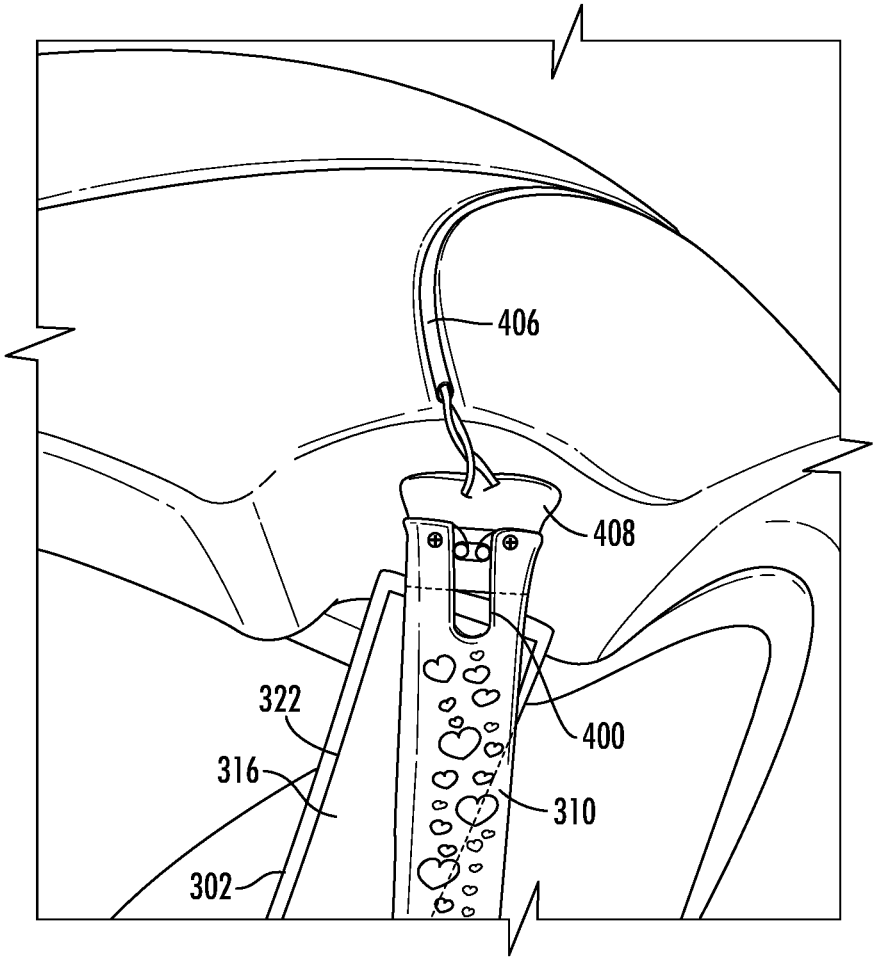
FIG. 4 is a close-up view of a portion of the helmet shown in FIG. 3, with a portion of the energy-management liner removed and the illuminable strip decoupled from the strap.

In some embodiments, the light source 400, 500 may be coupled to the straps 302, 304 (FIG. 4). FIG. 4 shows a zoomed-in view of a portion of the helmet 100 shown in FIG. 3 with the portion of the energy-management liner 202 around the light source 400 removed and the illuminable strip 310 decoupled from the strap 302. In this embodiment, the light source 400, 500 is attached directly to the illuminable strip 310, 312. In particular embodiments, the light source 400, 500 may be attached to a backing strip 408, and the backing strip 408 may be attached to the illuminable strip 310, 312 by an end of the illuminable strip 310, 312 being attached to the backing strip 408 via screws, staples, glue, or other methods known to a person skilled in the art. The light sources 400, 500 may be LEDs or incandescent lights or other light generating mechanisms known in the art. As a light source, LEDs generate less heat than incandescent lights, which is a factor to consider in designing the locations of the light sources in the helmet and choosing light sources.

The light from the light sources 400, 500 shine toward the straps 302, 304, and more specifically toward the illuminable strips 310. The light sources 400, 500 may emit light directly from or from adjacent to the lower surface 210 toward the straps 302, 304. In some embodiments, the light may shine toward an upper end of the straps 302, 304 to illuminate them from the upper end with the light passing through the strap 302, 304. In some embodiments, the light sources 400, 500 may be positioned angled with respect to the outward-facing surfaces 314 of the straps 302, 304, and emit light toward the straps 302, 304 to illuminate the outward-facing surfaces 314. In some embodiments, by illuminating the end of the illuminable strips on the straps, the illuminable strips 310, 312 may be lit throughout their extent by the light traveling or reflecting within the illuminable strips even when the illuminable strips bend with the shape of the wearer's face. The illustration of FIG. 2 shows that the light source 400, 500 could be positioned and oriented to shine into the end of the illuminable strip 310 or from a lower edge of the helmet toward a side of the illuminable strip 310, provided the light source 400, 500 illuminates the illuminable strip 310.

The first and second light sources 400, 500 are connected to a power source 402 and a controller 404 (FIG. 5). FIG. 5 shows a rear view of an example helmet 100 with the outer shell 204 removed. In the example helmet shown in FIG. 5, the controller 404 is located at a rear of the helmet. The controller 404 may be located at various other locations of the helmet 100 as well. The light sources 400, 500 are powered by a power source 402. The power source 402 may be positioned toward a rear of the helmet, a rear bottom of the helmet or elsewhere, and electrically associated with the controller 404. The controller 404 and the power source 402 may be attached to a circuit board 410. The circuit board 410 may be nested in the energy-management liner 202. It is contemplated that various lighting modes may be activated through selection by the user indicated through manipulation of the controller as an on/off button, a mode selector, or through other controller provided on the helmet. By doing this, the straps may be illuminated in a flashing mode or in various patterns. As shown in FIGS. 1A-4, decorative designs may be incorporated into the illuminable surfaces to add variety and a design component to various embodiments.

The first light sources 400 may share the same wiring 406 with the second light sources 500 (FIG. 5), or may have separate wiring associated with the controller to produce differing patterns. The wiring 406 may be attached to the outer surface of the energy-management liner 202 and may be embedded in the energy-management liner 202. For example, the wiring 406 may be placed in channels 412 on the outer surface of the energy-management liner 202 (FIG. 3). Alternatively, though less desirably, the wiring 406 may be positioned within the energy-management liner. The outer shell 204 may be placed over the energy-management liner 202 to hold the wiring 406 in place. In some embodiments, the wiring may be co-molded with the energy-management liner.

Figure 6:
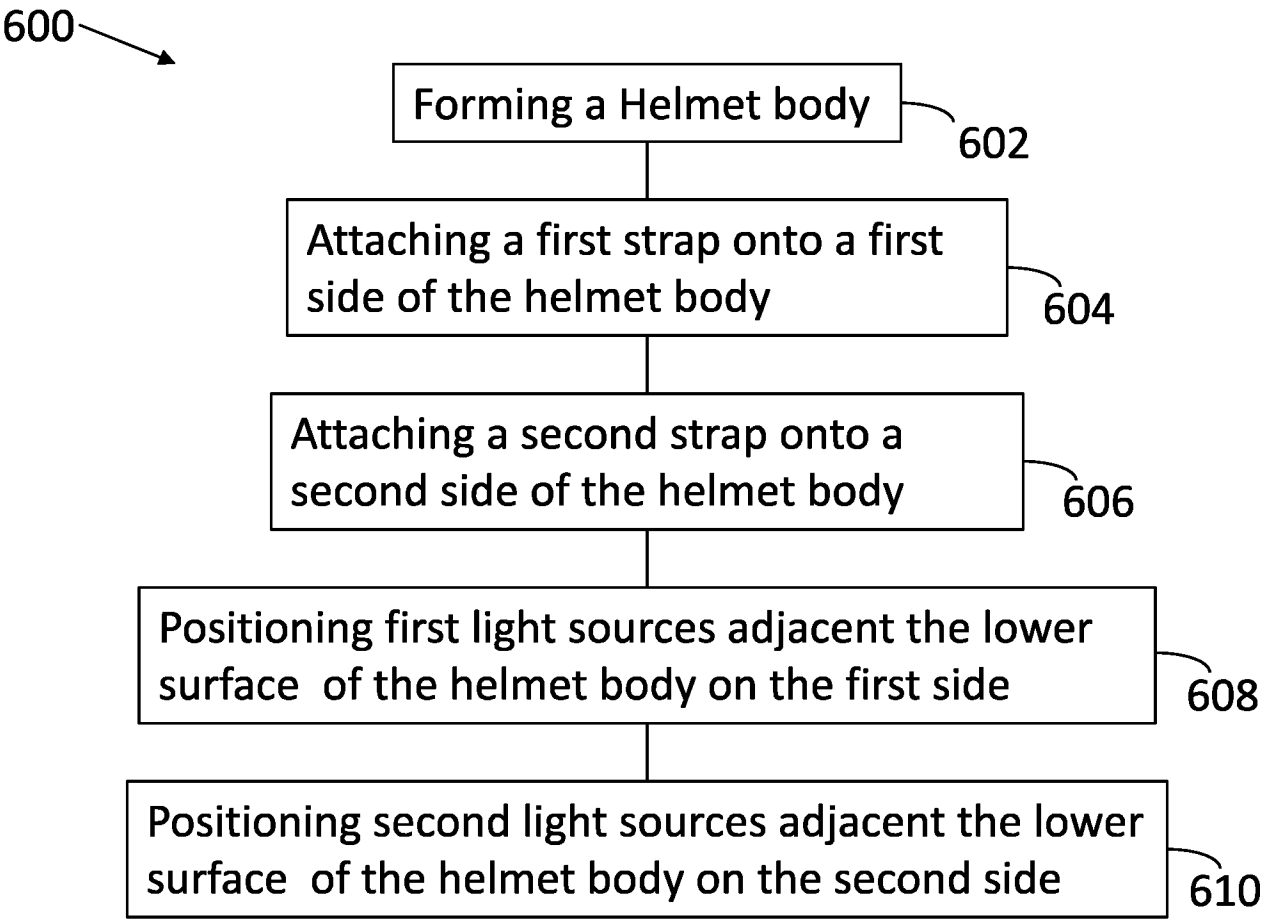
FIG. 6 is a flow chart of a method for increasing visibility of a helmet.

Methods for increasing the visibility of a helmet are also provided herein. FIG. 6 shows a flow chart of an example method 600. A method 600 comprises forming a helmet body (602) by including an energy-management liner. The helmet body comprises an inner surface, an outer surface, and a lower surface extending between the inner surface and the outer surface. The energy-management liner is disposed between the inner surface and the outer surface. The method 600 comprises attaching a first strap onto a first side of the helmet body such that one or more first illuminable surfaces of the first strap face outward (604) and attaching a second strap onto a second side of the helmet body such that one or more second illuminable surfaces of the second strap face outward (606). The method 600 further comprises positioning one or more first light sources adjacent the lower surface on the first side of the helmet body such that the first light sources are configured to emit light toward the first strap (608). The method 600 further comprises positioning one or more second light sources adjacent the lower surface on the second side of the helmet body such that the second light sources are configured to emit light toward the second strap (610).

In some embodiments, attaching a first strap may further comprise attaching one or more first illuminating strips having the one or more illuminable surfaces onto the first strap. In some embodiments, the method (600) may further comprise coupling the one or more illuminable strips onto the first strap via a translucent cover. In some embodiments, positioning one or more first light sources further comprises positioning at least one of the one or more first light sources directly superior to at least one of the one or more first light sources. In some embodiments, the method (600) may further comprise coupling the one or more first light sources to an end of the first strap.

To increase the safety for the wearer, the straps are lit without external light shone on the helmet. The light sources are placed at or adjacent to the lower surface of the helmet so that they emit light toward the straps to illuminate the outward-facing illuminable surfaces of the straps. As a result, the wearer is visible to others, especially drivers, without external light being required to shine on the wearer.

This disclosure, its aspects and implementations, are not limited to the specific components or assembly procedures disclosed herein. Many additional components and assembly procedures known in the art consistent with the intended helmets and methods of increasing visibility of a helmet will become apparent for use with implementations of the apparatus and methods in this disclosure. In places where the description above refers to particular implementations of protective helmets, it should be readily apparent that a number of modifications may be made without departing from the spirit thereof and that these implementations may be applied to other protective helmets. The presently disclosed implementations are, therefore, to be considered in all respects as illustrative and not restrictive, the scope of the disclosure being indicated by the appended claims rather than the foregoing description. All changes that come within the meaning of and range of equivalency of the description are intended to be embraced therein. Accordingly, for example, although particular helmets and methods of increasing visibility a helmet are disclosed, such apparatus, methods, and implementing components may comprise any shape, size, style, type, model, version, class, grade, measurement, concentration, material, quantity, the like as is known in the art for such apparatus, methods, and implementing components, and/or the like consistent with the intended operation of the helmet and methods of increasing visibility a helmet may be used.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

What is claimed is:

1. A helmet comprising:

a helmet body including an inner surface, an outer surface and a lower surface extending between the inner surface and the outer surface, the helmet body comprising an energy-management liner disposed between the inner surface and the outer surface and an outer shell covering at least a majority of the energy-management liner, the helmet body further including a first side and a second side opposite the first side;

a fit system comprising a first strap and a second strap, the first strap attached to the helmet body adjacent the lower surface at one or more first attachment points on the first side of the helmet body, the second strap attached to the helmet body adjacent the lower surface at one or more second attachment points on the second side of the helmet body, the first strap comprising one or more first illuminable strips disposed on one or more first outward-facing surfaces of the first strap, the second strap comprising one or more second illuminable strips disposed on one or more second outward-facing surfaces of the second strap;

one or more first light sources positioned adjacent the one or more first attachment points and the lower surface on the first side of the helmet and within the energy-management liner, at least one of the one or more first light sources positioned and oriented to emit a first light through and along the length of the one or more first illuminable strips of the first strap; and one or more second light sources positioned adjacent the one or more second attachment points and the lower surface on the second side of the helmet and within the energy-management liner, at least one of the one or more second light sources positioned and oriented to emit a second light toward the one or more second illuminable strips of the second strap.

2. The helmet of claim 1, wherein the one or more first light sources are positioned at the one or more first attachment points to emit the first light from the one or more first attachment points through at least a portion of the one or more first illuminable strips.

3. The helmet of claim 1, wherein the one or more first light sources are positioned adjacent the lower surface of the helmet body and are positioned to emit the first light toward the one or more first illuminable strips of the first strap from the lower surface of the helmet body.

4. The helmet of claim 1, wherein the one or more first illuminable strips of the first strap comprise thermoplastic polyurethane.

5. The helmet of claim 1, further comprising a controller, wherein the controller is operably coupled with the one or more first light sources.

6. The helmet of claim 1, wherein the one or more first illuminable strips are coupled with the first strap via one or more translucent covers on the first strap.

7. The helmet of claim 6, wherein the first strap further comprises a pocket formed by the one or more translucent covers, and at least a majority of at least one of the one or more first illuminable strips is disposed within the pocket.

8. The helmet of claim 1, wherein the one or more first light sources are attached to an end of the one or more first illuminable strips.

9. A helmet comprising:

a helmet body including an inner surface, an outer surface and a lower surface extending between the inner surface and the outer surface, the helmet body comprising an energy-management liner disposed between the inner surface and the outer surface, the helmet body further including a first side and a second side;

a fit system comprising a first strap and a second strap, the first strap attached to the helmet body at one or more first attachment points on the first side of the helmet body, the second strap attached to the helmet body at one or more second attachment points on the second side of the helmet body, wherein at least a portion of the first strap and a portion of the second strap are illuminable;

one or more first light sources positioned within the energy-management liner and adjacent the lower surface on the first side of the helmet body and positioned and oriented to emit a first light from adjacent the lower surface through and along the length of the first illuminable portion of the first strap; and one or more second light sources positioned adjacent the lower surface on the second side of the helmet body and positioned and oriented to emit a second light from adjacent the lower surface toward the second strap.

10. The helmet of claim 9, wherein at least one of the one or more first light sources is positioned directly superior to at least one of the one or more first attachment points.

11. The helmet of claim 9, wherein the one or more first light sources are positioned to emit the first light toward illuminable surfaces of the first strap.

12. The helmet of claim 9, wherein the first strap comprises one or more first illuminable strips.

13. The helmet of claim 12, wherein the one or more first illuminable strips are coupled to the first strap via one or more translucent covers.

14. The helmet of claim 13, wherein the first strap further comprises a pocket formed by the one or more translucent covers, and at least a majority of at least one of the one or more first illuminable strips is disposed within the pocket.

15. The helmet of claim 9, further comprising a controller, wherein the controller is operably coupled to the one or more first light sources.

16. The helmet of claim 9, wherein the one or more first light sources are coupled to an end of the first strap.

17. A method for increasing visibility of a helmet, the method comprising:

forming a helmet body that includes an energy-management liner, wherein the helmet body comprises an inner surface, an outer surface, and a lower surface extending between the inner surface and the outer surface;

attaching a first strap onto a first side of the helmet body such that one or more first illuminable surfaces of the first strap face outward;

attaching a second strap onto a second side of the helmet body such that one or more second illuminable surfaces of the second strap face outward;

positioning and orienting one or more first light sources within the energy-management liner and adjacent the lower surface on the first side of the helmet body such that the one or more first light sources emit a first light through and along the length of the one or more first illuminable surfaces; and positioning and orienting one or more second light sources adjacent the lower surface on the second side of the helmet body such that the one or more second light sources emit a second light toward the one or more second illuminable surfaces.

18. The method of claim 17, wherein attaching a first strap further comprises attaching one or more first illuminable strips having the one or more first illuminable surfaces onto the first strap.

19. The method of claim 18, further comprising coupling the one or more first illuminable strips onto the first strap via one or more translucent covers.

20. The method of claim 17, further comprising coupling the one or more first light sources to an end of the first strap.

* * * * *